United States Patent [19]

Zimmerman

[11] Patent Number: 4,502,363

[45] Date of Patent: Mar. 5, 1985

[54] METHOD AND TOOL FOR RECONDITIONING EXPENDED SHOTSHELLS

[76] Inventor: Ross W. Zimmerman, 113 S. Broadway, Box 324, Sterling, Kans. 67579

[21] Appl. No.: 513,466

[22] Filed: Jul. 13, 1983

[51] Int. Cl.[3] ..... F42B 33/10

[52] U.S. Cl. ..... 86/24; 86/25; 86/28; 425/11; 425/12; 425/DIG. 41; 425/DIG. 245

[58] Field of Search ..... 86/11, 23, 24, 25, 26, 86/28, 27, 39, 40, 41, 36, 37; 425/11, 12, DIG. 41, DIG. 245, DIG. 246

[56] References Cited

U.S. PATENT DOCUMENTS

| | | | |
|---|---|---|---|
| 3,196,736 | 7/1965 | Pace | 86/25 |
| 4,048,899 | 9/1977 | Buchhuber | 86/39 |
| 4,162,645 | 7/1979 | Abbott | 86/23 |
| 4,176,583 | 12/1979 | Lage | 86/24 |

*Primary Examiner*—Stephen J. Lechert, Jr.
*Assistant Examiner*—Howard J. Locker
*Attorney, Agent, or Firm*—Bernard L. Kleinke

[57] ABSTRACT

The thermoplastic shotshell reconditioning tool includes an elongated member having a front conductive tip portion adapted to be heated to a high temperature sufficient to melt the thermoplastic material of the shotshell tubular portion. A reduced diameter portion of the member is disposed rearwardly of the tip portion to retard axial heat transfer toward a rear handle portion. A generally cylindrical shell conditioning portion is disposed immediately rearwardly of the reduced diameter portion for receiving the heated mouth portion of the melted shell tubular portion to permit it to cool as the heated tip portion advances axially toward the base end portion of the shotshell. The outer surface of the tip portion is heated with a blow torch to a high temperature in the range of 250° F. and 350° F. The heated tip portion is manually inserted into snug contact with the crimped mouth portion of the expended shotshell to melt it for reshaping purposes.

14 Claims, 3 Drawing Figures

METHOD AND TOOL FOR RECONDITIONING EXPENDED SHOTSHELLS

DESCRIPTION

1. Technical Field

The present invention relates in general to a method and a tool for reconditioning expended shotshells, and it more particularly relates to a method and a tool for removing the axially extending crimps or creases in the deformed open mouth portion of an expended thermoplastic shotshell, to facilitate the reloading thereof.

2. Background Art

There have been several different types and kinds of shotshell reloading devices. For example, reference may be made to U.S. Pat. Nos. 3,196,736 and 4,176,583.

Shotshells, such as Magnum 10 gauge shotshells, include thermoplastic tubular portions having a base portion at one end and an open mouth portion at its opposite end. The tubular portion is very stiff and rigid, and once fired, axially extending crimps or creases in the form of ridges develop at the mouth portion of the shell.

Conventional reloading devices, such as those shown in the foregoing mentioned patents, are not able to conveniently remove the crimps, and thus the spent shells are not readily re-loaded with powder and shot.

In the above-mentioned patents, the reloading machines and devices shown therein include presses or other devices for forcefully pushing a member axially down into the deformed shell for swedging or otherwise forcefully pushing the crimp back out to its nearly original circular configuration. Thus, the heretofore known reloading machines have not completely eliminated the creases in the spent shotshell so that the subsequent reloading process in very difficult and awkward.

Additionally, for some applications, ballistic pattern drivers, in the form of tubular plastic inserts, are slipped into the shotshell. However, should the crimps or creases not be completely, or at least substantially completely removed prior to the insertion of the driver, it is difficult to insert the driver down into the tubular shotshell until it comes to rest on the powder at the bottom thereof.

If the shell is out of round, due to the presence of the crimps or creases, which were not completely removed, the ballistic pattern driver can be damaged if it is not carefully inserted into the shell. The damage to the driver almost always occurs to the seal and thus adversely affects the flight pattern of the ballistic pattern driver. Thus, undesirable flight patterns of the shot result.

Therefore, it would be highly desirable to have a new method and tool for reconditioning expended shotshells to facilitate the reloading thereof. In this regard, such a method and tool should enable one to readily and conveniently recondition the crimped shotshell to make it substantially circular in cross-section throughout its length to enable it to receive readily a ballistic pattern driver, where desired. Such a tool should be relatively inexpensive to manufacture, and it should be multi-functional.

DISCLOSURE OF THE INVENTION

The principal object of the present invention is to provide a new and improved method and tool for reconditioning spent shotshells, in a convenient manner.

Such a new and improved method and tool should be able to return the shotshell substantially to its original circular cross-sectional configuration.

A further object of the present invention is to provide such a new and improved tool, which is also relatively inexpensive to manufacture, and which is multi-functional.

Briefly, the above and further objects of the present invention are realized by providing a new method and tool for reconditioning expended shotshells in a convenient manner, so as to return the shotshell to a substantially circular cross-sectional configuration throughout its length.

The tool includes an elongated cylindrical body member having a rear handle portion and having a shell conditioning conductive tip portion at the front end thereof. The outer surface of the tip portion is adapted to be heated to a high temperature sufficient to melt the thermoplastic material of the shotshell tubular portion. A reduced diameter portion of the member is disposed adjacent to and rearwardly of the cylindrical member to retard axial heat transfer from the tip portion toward the handle portion thereof. A generally cylindrical shell conditioning portion is disposed adjacent and rearwardly of the reduced diameter portion for receiving the melted end portion of the tubular portion of the shotshell to maintain its circular cross-sectional shape as the heated tip portion advances axially toward the end portion of the shell body.

In operation, the outer surface of the tip portion is heated with a blow torch to a high temperature in the range of 250° F. and 350° F. The heated tip portion is manually inserted into snug contact with the crimped mouth portion of the expended shotshell body to melt and thus to reshape it. In this regard, the tool is manipulated to smooth out the crimps in the mouth portion to restore it to a generally circular cross-sectional configuration.

BRIEF DESCRIPTION OF DRAWINGS

The above-mentioned and other objects and features of this invention and the manner of attaining them will become apparent, and the invention itself will be best understood by reference to the following description of an embodiment of the invention taken in conjunction with the accompanying drawings, wherein.

BEST MODE FOR CARRYING OUT THE INVENTION

Figure 1:
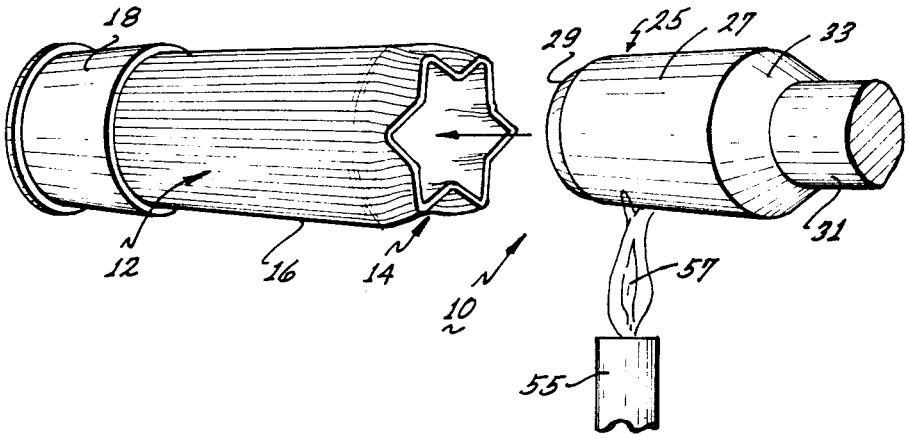
FIG. 1 is a pictorial fragmentary view of the tool for reconditioning a spent shotshell, in accordance with the present invention, an initial step of the method for reconditioning the shotshell being illustrated.
Figure 2:
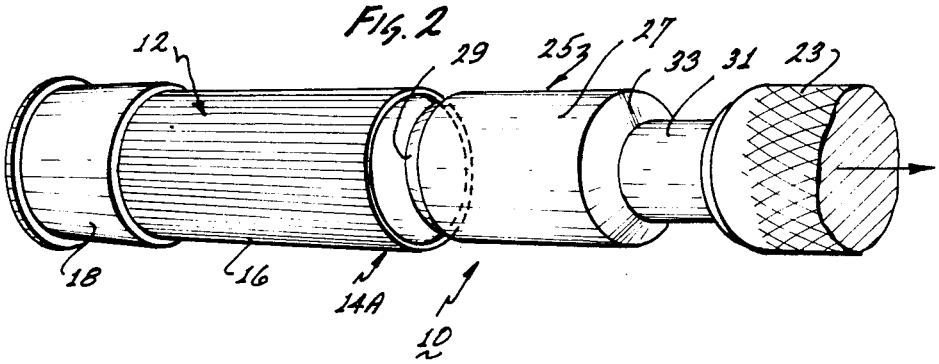
FIG. 2 is a fragmentary pictorial view of the tool of FIG. 1, illustrating the step of removing the tool from the shotshell after removing the creases therein.

Referring now to the drawings, and more particularly to FIGS. 1 and 2 thereof, there is shown a tool 10, which is constructed in accordance with the present invention, and which is adapted to recondition a spent shotshell 12. As shown in FIG. 1, the spent shotshell 12 has a crimped or creased forward open mouth portion 14 of a hollow tubular portion 16 composed of thermoplastic material and having a brass rear base end portion 18. The tubular member 16 is generally circular in cross-section throughout its length in its original condition prior to firing. After firing, the member 16 is deformed as shown.

As shown in FIG. 2, by inserting the preheated tool 10 axially into the creased open mouth portion 14, the open mouth portion 14 is smoothed and is returned to its original circular cross-sectional shape as indicated at 14A of FIG. 2.

Figure 3:
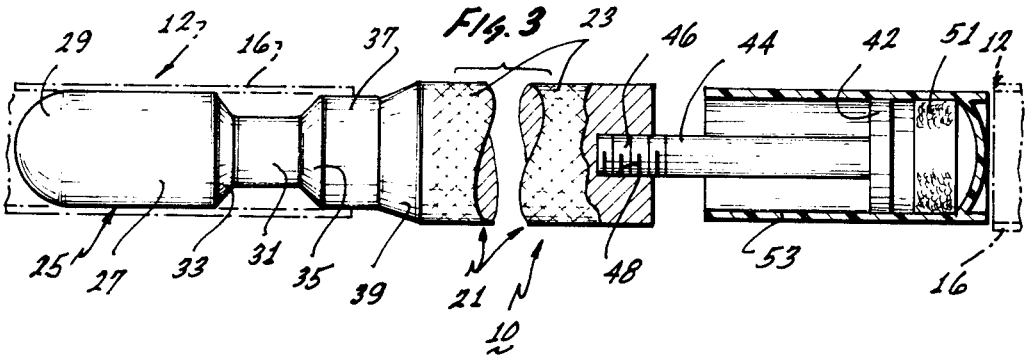
FIG. 3 is a fragmentary, sectional view of the tool of FIG. 1, showing it in the process of inserting a spacer into a ballistic pattern driver.

As best seen in FIG. 3, the tool 10 generally comprises an elongated body member 21 having a rear knurled handle portion 23, which is adapted to be grasped by the hand of the user during the reconditioning operation. A conductive tip portion generally indicated at 25 is disposed on the front end portion of the elongated member 21. The tip portion 25 is dimensioned to fit snugly within the mouth portion 14 of the shotshell 12. In this regard, the member 21 is generally circular in its cross-sectional configuration throughout its axial length.

The body member 21 is a unitary one-piece construction, and is composed of a suitable conductive material, such as a mild steel. Thus, the member 21 is relatively inexpensive to manufacture.

The tip portion 25 includes a generally cylindrical intermediate portion 27 terminating in a smoothly contoured, forwardly-disposed blunt distal end portion 29. The member 21 includes a reduced diameter portion 31 disposed adjacent to a forward tapered intermediate portion 33, which, in turn, is disposed adjacent to the tip portion 25. The reduced diameter portion 31 is spaced rearwardly axially from the cylinder portion 27 to retard axial heat transfer from the tip portion 25 toward the handle portion 23.

A generally cylindrical shell conditioning portion 37 extends between a rearwardly disposed tapered intermediate portion 35, which, in turn, extends between the reduced diameter portion 31 and the reconditioning portion 37. The conditioning portion 37 is generally circular in its cross-sectional configuration, and is dimensioned to fit snugly within the mouth portion of the tubular body 16.

Due to the cylindrical portion 27, the shell conditioning portion 37 remains at a lower temperature relative to the high temperature of the tip portion 25, and receives the heated mouth portion 14 of the shotshell 12 to maintain its circular corss-sectional shape as the heated tip portion 25 advances axially toward the base end portion 18 of the tubular portion 16. The lower temperature of the shell conditioning portion 37 permits the heated end portion to cool to a certain extent and to assume its circular configuration, as the tip portion 25 advances rearwardly toward the base end portion 18.

As the tip portion 25 enters the tubular portion, the melted mouth portion extends over the conditioning portion 37 and the reduced diameter portion 31 for cooling purposes. Thus, the reduced diameter portion serves multiple cooling functions—for the handle portion, for the conditioning portion 37, and the tubular portion 16 of the shotshell itself.

The reduced diameter portion 31 and the conditioning portion 37 have substantially the same diameter, which is substantially the same as the inside diameter of the shotshell tubular portion 16. The cylindrical portion 27 and the conditioning portion 37 are continuously axially tapered increasing in cross-sectional area from the tip end 25 rearwardly to facilitate the entering of the tubular portion 16.

At the rear end of the member 21 is a rammer disk 42 fixed at the distal rearward end of an axially rearwardly extending rod or stem 44, which has a forward threaded end 46 secured in a tapped axially-aligned hole 48 in the rear end of the member 21. The disk 42 is an enlarged head portion of the stem 44 and is used to push an item, such as a conventional spacer disk 51 into the bottom end of a ballistic pattern driver 53, which is conventional and which may be purchased from Ballistic Products, Inc., located at 2105 Shaughnessy Circle, P.O. Box 488, Longlake, Minn. 55356.

The disk 51 has substantially the same diameter as the inside diameter of the tubular portion, and is only slightly smaller than it. In this manner, the disk 51 fits snugly within the pattern driver 53, which, in turn, is slightly smaller in diameter than the inside diameter of the tubular portion.

Considering now the novel method of the present invention, the tip portion 25 of the tool 10 is heated by means of a source of heat, such as a blow torch 55 applying a flame 57 to the outer surface thereof. The heat is applied until the temperature of the tip portion 25 reaches the desired high temperature in the range of approximately 250° F. and approximately 350° F. At this temperature range, the temperature is sufficient to melt the thermoplastic material of the shotshell body 16.

After the tip portion 25 is heated, the tool is grasped by the hand of the user by holding the handle 23 which remains cooler to the touch as a result of the reduced diameter portion 31 retarding rearward heat transfer. The heated tip portion 25 is manually inserted into snug contact with the crimped mouth portion 14 of the expended shotshell body to melt the forward end portion thereof, and manipulating the tool to smooth out the creases and crimps in the forward end mouth portion to restore it to a generally circular cross-sectional configuration.

Once the forward end of the tubular member 16 is smooth and is returned substantially to its original circular configuration, the tubular body 16 is then permitted to cool.

While it is preferred to heat the tip portion 25 to the ranges specified previously, it is still further preferred to heat the tip portion 25 within the range of approximately 275° F. and approximately 325° F. An even more preferred temperature is approximately 300° F.

While a particular embodiment of the present invention has been disclosed, it is to be understood that various different modifications are possible and are contemplated within the true spirit and scope of the appended claims. For example, while the preferred material of the elongated member 21 is a mild steel, other metals may also be employed. There is no intention, therefore, of limitations to the exact abstract or disclosure herein presented.

What is claimed is:

1. A hand tool for reconditioning an expended shotshell including a hollow tubular portion composed of thermoplastic material and a closed end base portion, said tubular portion having an opened mouth portion at the opposite end thereof, said mouth portion being crimped axially, comprising: an elongated body member having a rear handle portion terminating at its front end in a conductive tip portion, said handle being adapted to be held in the hand of the user, the outer surface of said tip portion being adapted to be heated by an external source of heat to a high temperature in a range between 275 degrees Fahrenheit and about 325 degrees Fahrenheit sufficient to melt the thermoplastic material of the shotshell tubular portion and to be inserted into the tubular portion of the shotshell to smooth out the axially extending crimps for reshaping purposes, said body member having an intermediate reduced diameter portion disposed adjacent to and rearwardly of the tip portion of the body member to retard greatly the axial rearward transfer of heat therethrough, and said body member having a generally cylindrical larger diameter shell conditioning portion disposed adjacent and rearwardly of the reduced diameter portion to maintain said shell conditioning portion at a lower temperature relative to the hot tip portion, said shell conditioning portion for receiving the melted mouth portion of the tubular portion of the shotshell and for permitting it to cool slightly to maintain its circular cross-sectional shape as the heated tip portion advances manually in an axial direction toward the end portion of the tubular portion, wherein said reduced diameter portion and said conditioning portion each has substantially the same diameter and each is axially tapered increasing in cross-sectional area from the tip end portion rearwardly to facilitate the entering of the interior of the shotshell tubular portion, said handle portion being disposed in an axial rearward direction of said shell conditioning portion to be maintained at a lower temperature to permit the grasping thereof by the hand of the user.

2. A tool according to claim 1, wherein said elongated body member is composed of a one-piece unitary construction throughout its length.

3. A tool according to claim 2, wherein said elongated member is composed of steel.

4. A tool according to claim 3, wherein said handle portion is knurled.

5. A tool according to claim 1, further including an item pushing circular rammer disk having substantially the same diameter as the inside diameter of said tubular portion.

6. A tool according to claim 5, further including a stem extending axially rearwardly from the rear end of said elongated member and terminating at its opposite end at said circular disk.

7. A method of reconditioning an expended shotshell having a tubular thermoplastic portion terminating in a closed end base portion, the opposite end being open at a mouth portion by using a tool as specified in claim 1, the steps comprising:

providing a hand held tool having an elongated body member, the body member including a tip portion and a handle portion;

heating the tip portion with a source of external heat to a high temperature in a range between about 275° F. and about 325° F. sufficient to melt the shotshell tubular portion;

manually grasping the handle portion and inserting the heated tip portion into the opened mouth portion of the tubular portion of the shotshell to melt and reshape it;

allowing the forward end portion of the melted shotshell tubular portion to cool while advancing said tip portion still further axially within said tubular portion toward the base portion; and withdrawing the tip portion from the mouth portion.

8. A method according to claim 7, wherein said high temperature is substantially 300° F.

9. A method according to claim 7, wherein said step of manually inserting the heated tip portion further, includes continuing to manually insert the heated tip portion to melt the inside wall of said tubular portion as the heated tip portion advances axially therewithin, and permitting the mouth portion of the tubular portion to cool as the tip portion advances toward the base end.

10. A method according to claim 9, wherein the tool includes a reduced diameter portion disposed adjacent to and rearwardly of said tip portion to retard axial heat transfer from the tip portion toward the handle portion, and a generally cylindrical shell conditioning portion being disposed adjacent to and rearwardly of said reduced diameter portion, said allowing of the forward end portion of the shell to cool while advancing said tip portion is accomplished by slipping the forward end of the tubular member over the reduced diameter portion.

11. A method according to claim 10, wherein said tool further includes a generally cylindrical shell conditioning portion disposed adjacent to and rearwardly of said reduced diameter portion, and the step of permitting the mouth portion of the shell to cool includes receiving the mouth portion of the shotshell tubular portion over the shell conditioning portion to maintain its circular cross-sectional shape as the heated tip portion advances axially toward said base end portion.

12. A method according to claim 11, wherein said shell conditioning portion has a low temperature substantially below said high temperature of said tip portion.

13. A method according to claim 7, wherein said tool further includes a rearwardly extending stem portion terminating in an enlarged head portion, further including pushing an item into the reshaped tubular portion with said head portion while grasping said handle portion manually.

14. A tool for reconditioning an expended shotshell having a rear base end and a tubular portion, said tubular portion being generally circular in cross-section throughout its length and being composed of thermoplastic material, the tubular portion having an axially crimped front-end mouth portion, comprising:

an elongated member having a handle portion;

a conductive tip portion at the front end thereof dimensioned to fit snugly within the mouth portion of the shotshell and adapted to be heated by an external source of heat to a high temperature in a range between about 275 degrees Fahrenheit and about 325 degrees Fahrenheit sufficient to melt the thermoplastic material of the shotshell tubular portion;

an intermediate reduced diameter portion disposed adjacent to and rearwardly of the tip portion of the elongated member to retard greatly the axial rearward transfer of heat;

a generally cylindrical larger diameter portion disposed adjacent and rearwardly of the reduced diameter portion;

a handle portion adapted to be held by the hand of the user and disposed in an axial rearward direction of said larger diameter portion, said larger diameter portion and said handle portion each being maintained at a lower temperature relative to said tip portion; and a stem extending axially rearwardly from said handle portion of the elongated member terminating in a circular disk for pushing an item into said tubular portion.

* * * * *

UNITED STATES PATENT AND TRADEMARK OFFICE

CERTIFICATE OF CORRECTION

PATENT NO. : 4,502,363

DATED : March 5, 1985

INVENTOR(S) : Ross W. Zimmerman

It is certified that error appears in the above-identified patent and that said Letters Patent are hereby corrected as shown below:

Column 1, line 37 after "process", delete "in" and substitute --is-- therefor.

Column 3, line 6, delete "open".

Column 3, line 47 after "circular", delete "corss-sectional" and substitute --cross-sectional-- therefor.

Column 3, line 61 after "The", delete "reduced diameter portion 31" and substitute --cylindrical portion 27-- therefor.

Signed and Sealed this

*Twenty-fourth* Day of *September 1985*

[SEAL]

*Attest:*

*Attesting Officer*

DONALD J. QUIGG

*Commissioner of Patents and Trademarks—Designate*